United States Patent [19]

White

[11] Patent Number: 4,712,764

[45] Date of Patent: Dec. 15, 1987

[54] FLEXIBLE FORMS

[76] Inventor: Lee Roy White, 1137 W. Emerald, Mesa, Ariz. 85202

[21] Appl. No.: 867,233

[22] Filed: May 23, 1986

[51] Int. Cl.[4] ..... E01C 19/50

[52] U.S. Cl. ..... 249/6; 249/7; 249/134; 249/192

[58] Field of Search ..... 249/2-8, 249/192, DIG. 3, 1, 134, 135, 183

[56] References Cited

U.S. PATENT DOCUMENTS

| | | | |
|---|---|---|---|
| 2,663,925 | 12/1953 | Yates | 249/7 |
| 4,340,200 | 7/1982 | Stegmeier | 249/6 |
| 4,579,312 | 4/1986 | White | 249/6 |

*Primary Examiner*—Jay H. Woo
*Assistant Examiner*—James C. House
*Attorney, Agent, or Firm*—Harry M. Weiss & Associates

[57] ABSTRACT

An elongated flexible form is disclosed. The elongated flexible form may be shaped to fit the contour of a concrete structure of variable shape and is held in position by a plurality of positioning brackets. The flexible form is made out of a flexible material such as natural or synthetic rubber and may be reinforced by metal strips, cable mesh, metal mesh, nylon mesh or a combination of the same. Each of the positioning brackets has a hollow body portion which is molded to a flexible form or welded to a metal plate which is molded to the flexible form. A stake and wedge combination are used to hold each bracket in place. Connecting flanges may be used to attach the end of the flexible form to another flexible form or to a metal form. The connecting flanges are molded or welded to a metal plate which are molded to the end of each form and are held together by a fastening device. The flexible form has a plurality of ribs therealong said form to provide strength and to reduce the required thickness thereof.

4 Claims, 3 Drawing Figures

FLEXIBLE FORMS

BACKGROUND OF THE INVENTION

The present invention relates generally to forms used for pouring concrete structures and, more specifically, to a flexible form that may be used for pouring concrete structures of variable shape.

Flexible sheet metal forms or wooden forms are often used for the purpose of pouring concrete structures such as curbs, walls or sidewalks of variable shape. However, wooden forms generally are not reusable and are difficult to use due to their lack of flexibility. In addition, sheet metal forms are expensive and difficult to use when pouring concrete structures of variable shape. In the case of concrete structures with extreme changes in contour or shape, it would be impractical to use wooden or sheet metal forms.

Accordingly, there is a need for a form made out of a flexible material, such as natural or synthetic rubber, which may be used for pouring concrete structures of variable shape. The flexible form should be reinforced by wire, cables, steel belts, nylon cord, ply material or a combination of the same, as well as a plurality of ribs therealong said form to provide strength and to reduce the required thickness thereof. In addition, the flexible form should be capable of being used in conjunction with existing metal forms.

The present invention is related to the invention of the inventor in U.S. Pat. No. 4,579,312 which issued Apr. 1, 1986.

SUMMARY OF THE INVENTION

It is an object of this invention to provide an improved flexible form that may be used for pouring concrete structures of variable shape.

It is still another object of this invention to provide an improved flexible form made out of a reinforced flexible material.

It is still another object of this invention to provide an improved flexible form which may be used in conjunction with existing metal forms.

It is still a further object of this invention to provide an improved flexible form having positioning brackets thereof suitable for fastening a plurality of said improved flexible forms.

It is still a further object of this invention to provide an improved flexible form having ribs therealong said form to provide strength and to reduce the required thickness thereof.

In accordance with one embodiment of this invention, a flexible form for use in concrete work is disclosed which comprises an elongated flexible member capable of being bent and shaped during use as a concrete form in order to fit the variable contour of a concrete structure, the flexible member resting on one of its longitudinal edges which extends lengthwise in a horizontal direction and having at least one substantially flat vertical side; and positioning bracket means coupled to the flexible member for supporting and anchoring the flexible member. It is preferred that the positioning bracket means be molded into the flexible member or welded onto a metal plate member which is molded into said flexible member. In this embodiment, an elongated flexible form which may be shaped to fit the contour of a concrete structure of variable shape is held in position by a plurality of positioning brackets. The flexible form is made out of a flexible material such as natural or synthetic rubber and may be reinforced by metal strips, cable mesh, metal mesh, nylon mesh or a combination of the same. Each of the positioning brackets has a hollow body portion which is either molded into the flexible member or welded onto a metal plate member which is molded into said flexible member form. A stake and wedge are used to hold each bracket in place. Connecting flanges may be used to attach the end of the flexible form to another flexible form or to a metal form. The connecting flanges are molded to the end of each form and are held together by a fastening device. Another embodiment of the positioning brackets may be molded to the end of the flexible form and also used for the purpose of attaching the end of the flexible form to another form.

The foregoing and other objects, features and advantages of this invention will be apparent from the following, more particular, description of the preferred embodiments of the invention, as illustrated in the accompanying drawings.

DESCRIPTION OF THE PREFERRED EMBODIMENT

Figure 1:
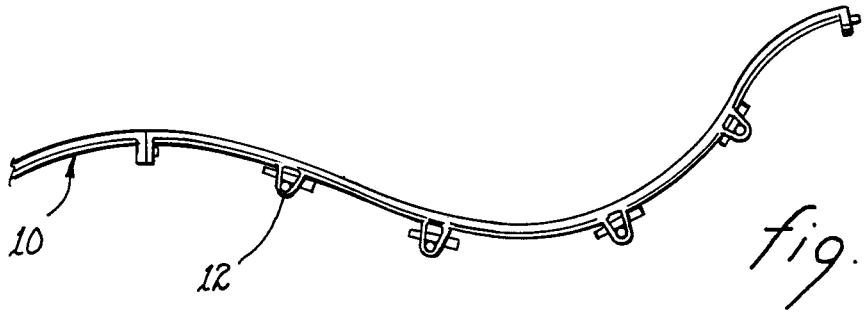
FIG. 1 is a top view showing a flexible form connected to two adjacent forms by connecting flanges with a plurality of positioning brackets holding the form in place.

FIG. 1 shows a flexible form, generally designated by reference number 10. The flexible form 10 is preferably made out of a flexible material such as natural or synthetic rubber, flexible plastic, or the like. Since the form 10 is flexible, it may be shaped to fit concrete structures of variable shape, such as curbs. The flexible form 10 is held in place by a plurality of positioning brackets.

Figure 2:
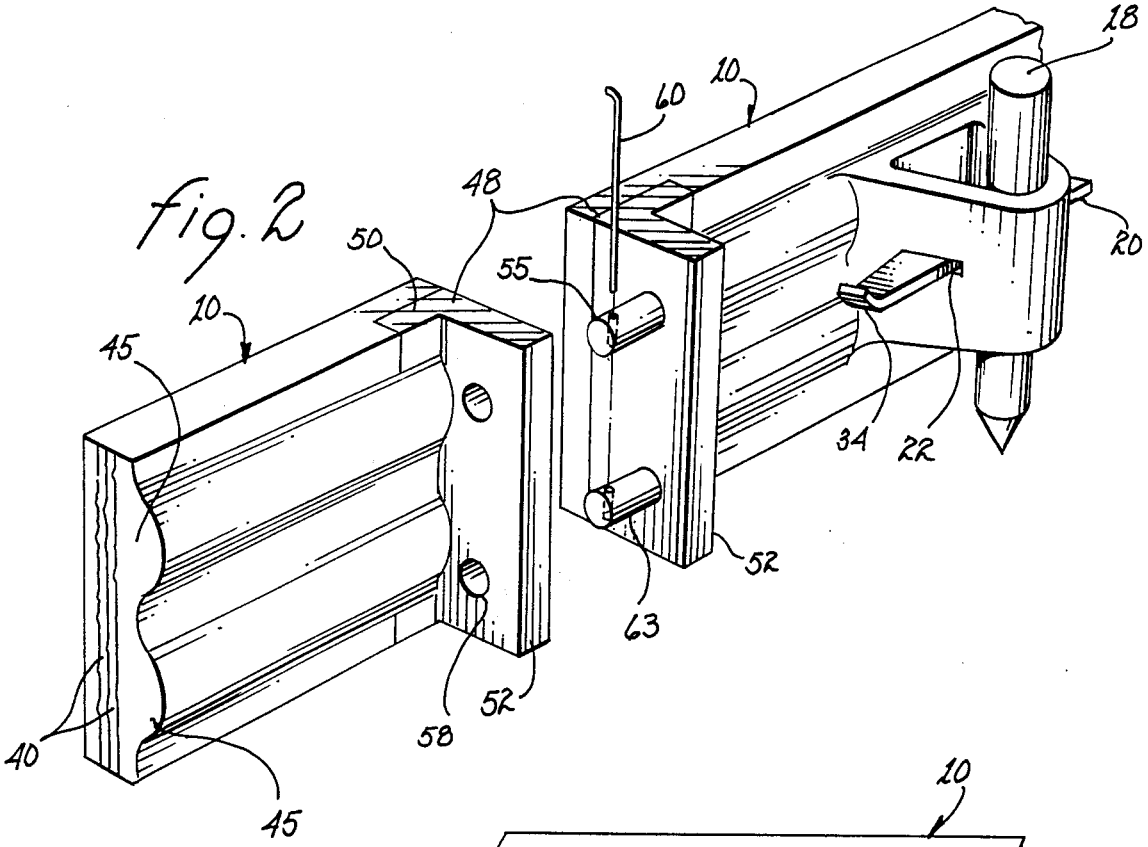
FIG. 2 is an exploded perspective view of the joint of the present invention.

As shown in FIG. 2, the flexible form 10 may be reinforced metal strips, cable mesh, metal mesh, nylon mesh material 40. Any desirable number of layers of reinforced material 40 may be used to reinforce the flexible form 10. In order to provide strength and to reduce the required thickness of the flexible form 10, a plurality of rib members 45 are integral or molded along therethroughout the flexible form. The rib members 45 are preferably made out of rubber.

Also, as shown in FIG. 2, connecting members 48, preferably in a substantially L-shaped configuration having a preferably short side member 50 molded into the flexible form 10 or welded onto a preferably thin metal plate member (not shown) molded onto said flexible form 10 are illustrated. Also shown in FIG. 2, is a preferably long side member 52 of the L-shaped connecting member 48 protruding therefrom the short side member 50 thereof. At least one of the long side members 52 has at least one protruding member 55 extending therefrom. An opposingly located long side member 52 has at least one aperture 58 passing therethrough to accommodate therein said protruding member 55. In order to lock the protruding member 55 into the aperture 58, a pin member 60 is allowed to pass therethrough, preferably in a vertical direction, apertures 63 through the protruding members 55.

Figure 3:
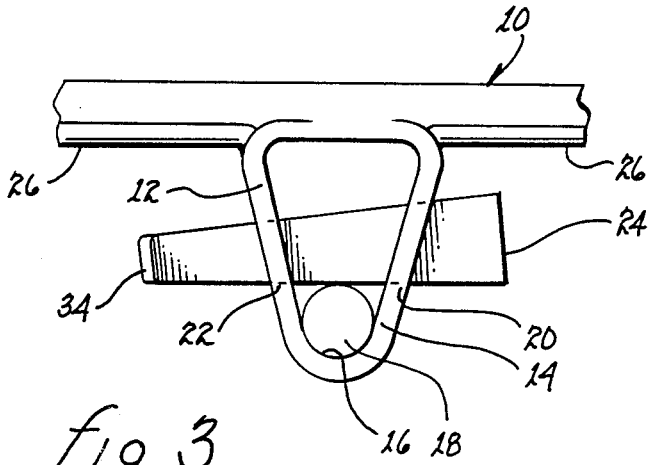
FIG. 3 is a top view of one of the positioning brackets showing how a wedge and stake are used with said bracket.

The positioning bracket 12 as shown in FIG. 3 has a hollow body portion 14 having a curved inside surface 16 for engaging a stake 18. A wedge 24 slidably engages slots 20 and 22 (see FIG. 2) in the hollow body portion 14. The wedge 24 has an upward extension 34 which prevents the wedge 24 from sliding out of the slots 20 and 22. The hollow body portion 14 has an inner portion which can be formed as a molded part of the flexible form 10 or, alternatively, two flanges 26 suitable for molding into the flexible form 10 or welding onto a metal plate member (not shown) is molded into the flexible form 10. After the positioning bracket 12 is molded to the flexible form 10, the stake 18 is placed inside the hollow body portion 14 and driven into the ground. The wedge 24 is then inserted through slots 20 and 22 until it comes into contact with the stake 18 forcing it against the curved inside surface 16.

The positioning brackets 12 and connecting flanges 26 are preferably made out of metal. However, any suitable material may be used.

While the invention has been particularly shown and described in reference to preferred embodiments thereof, it will be understood by those skilled in the art that changes in the form and details may be made therein without departing from the spirit and scope of the invention.

I claim:

1. A flexible form for use in concrete work, comprising:

an elongated flexible member means suitable for being bent and shaped during use as a concrete form for fitting onto the variable contour of a concrete structure, said flexible member means is adapted to rest on one of its longitudinal edges which extends lengthwise in a horizontal direction and having a substantially vertical side;

connecting member means having a first member and a second member each extending outwardly from a side opposite said vertical side and on opposite ends of the flexible member means, said first member having at least one protruding member protruding orthogonally therefrom, each protruding member having at least one aperture through which a pin member extends, said second member having at least one opening therein corresponding to the protruding member, whereby two or more flexible member means are connectable together by inserting the protruding member of a first member of one flexible member means into an opening of a second member of another flexible member means, and then inserting a pin member into an aperture in the protruding member;

a plurality of reinforcement means integral and therealong said elongated flexible member means;

a plurality of horizontal arcuate shaped rib means integral to said elongated flexible member means for providing strength thereto; and a positioning bracket means integrally connected to said elongated flexible member means for holding said flexible form in place, said positioning bracket means comprises (a) a hollow body portion having slots passing therethrough and flanges extending therefrom; (b) a stake member means for removably inserting inside said hollow body portion; and (c) a wedge means for slidably engaging said slots and operably securing said stake member means inside said hollow body portion, said wedge mans has an extension for preventing said wedge means from sliding out of the slots.

2. The flexible form as in claim 1 wherein said reinforcement means are made of metal and nylon material.

3. The flexible form as in claim 2 wherein said first member of said connecting member means being integrally molded onto said flexible member means.

4. The flexible form as in claim 2 wherein said first member of said connecting member means being connected by welding onto a metal plate member which is molded onto said flexible member means.

* * * * *